US012714267B2

(12) United States Patent
Laitala et al.

(10) Patent No.: US 12,714,267 B2
(45) Date of Patent: Aug. 25, 2026

(54) SHEET PRODUCT DISPENSER WITH PRESSURE PLATE LOADING CONTROL

(71) Applicant: GPCP IP Holdings LLC, Atlanta, GA (US)

(72) Inventors: John Patrick Laitala, Appleton, WI (US); Ted Allen Casper, Freedom, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 389 days.

(21) Appl. No.: 18/237,900

(22) Filed: Aug. 25, 2023

(65) Prior Publication Data

US 2025/0064275 A1 Feb. 27, 2025

(51) Int. Cl.
*A47K 10/32* (2006.01)

(52) U.S. Cl.
CPC ..... *A47K 10/32* (2013.01); *A47K 2010/3253* (2013.01)

(58) Field of Classification Search
CPC ..... A47K 10/32
See application file for complete search history.

(56) References Cited

U.S. PATENT DOCUMENTS

| | | | |
|---|---|---|---|
| 6,036,134 | A | 3/2000 | Moody |
| 6,202,956 | B1 | 3/2001 | Grasso et al. |
| 6,592,068 | B2 | 7/2003 | Taylor et al. |
| 6,736,348 | B1 | 5/2004 | Formon |
| 6,752,349 | B2 | 6/2004 | Moody et al. |
| 7,083,138 | B2 | 8/2006 | Elliott et al. |
| 7,422,174 | B2 | 9/2008 | Elliott et al. |
| 7,461,810 | B2 | 12/2008 | Goeking et al. |
| 7,780,112 | B2 | 8/2010 | Granger et al. |
| 7,841,558 | B2 | 11/2010 | Elliott et al. |
| 7,861,964 | B2 | 1/2011 | Cittadino et al. |
| 8,448,890 | B2 | 5/2013 | Hagleitner |

(Continued)

FOREIGN PATENT DOCUMENTS

| | | | |
|---|---|---|---|
| CA | 2430464 | C | 12/2010 |
| CA | 2430678 | C | 1/2011 |

(Continued)

OTHER PUBLICATIONS

Pressure Plate Tissue Dispenser, pp. 4.

*Primary Examiner* — Gene O Crawford
*Assistant Examiner* — Ayodeji T Ojofeitimi

(57) ABSTRACT

Sheet product dispensers provided herein include a spindle mounted to a spindle mounting arm. A pressure plate positioned at least partially within the spindle mounting arm aligns with a roll of sheet product installed on the spindle. When the spindle mounting arm is in a dispensing state and the pressure plate is unextended, the pressure plate is configured to prevent rotation of the spindle mounting arm to a loading state, and, when the spindle mounting arm is in the dispensing state and the pressure plate is extended, the pressure plate is configured to allow transition of the spindle mounting arm to the loading state. Force from the roll of sheet product causes the pressure plate to remain unextended, and a sufficient amount of sheet product from the roll of sheet product having been depleted removes the force such that the pressure plate becomes extended.

20 Claims, 6 Drawing Sheets

(56) References Cited

U.S. PATENT DOCUMENTS

| | | | | |
|---|---|---|---|---|
| 8,616,489 | B2 | 12/2013 | Goeking et al. | |
| 8,740,132 | B2 | 6/2014 | Kling et al. | |
| D761,585 | S | 7/2016 | Roche et al. | |
| D766,612 | S | 9/2016 | Roche et al. | |
| D781,067 | S | 3/2017 | Cross et al. | |
| 9,675,217 | B2 | 6/2017 | Hagleitner | |
| 9,681,783 | B2 | 6/2017 | Goeking et al. | |
| 9,756,993 | B2 | 9/2017 | Hagleitner | |
| 9,839,333 | B2 | 12/2017 | Goeking et al. | |
| D818,737 | S | 5/2018 | Cross | |
| D818,738 | S | 5/2018 | Cross | |
| 9,994,348 | B2 | 6/2018 | Kling et al. | |
| D850,145 | S | 6/2019 | Roche | |
| 10,383,488 | B2 | 8/2019 | Ziebart et al. | |
| D902,620 | S | 11/2020 | Roche | |
| 10,835,086 | B2 | 11/2020 | Osborne, Jr. | |
| 10,994,883 | B2 | 5/2021 | Kling et al. | |
| 11,142,419 | B2 | 10/2021 | Osborne, Jr. | |
| 11,155,435 | B2 | 10/2021 | Worthington | |
| 11,155,436 | B2 | 10/2021 | Worthington | |
| 11,337,567 | B2 | 5/2022 | Lewis et al. | |
| 11,540,675 | B2 | 1/2023 | Mattheeussen et al. | |
| 2005/0072874 | A1* | 4/2005 | Denen | A47K 10/36 242/563 |
| 2008/0078855 | A1 | 4/2008 | Forman et al. | |
| 2009/0308966 | A1 | 12/2009 | Hjort et al. | |
| 2012/0280078 | A1 | 11/2012 | Lowe | |
| 2020/0008630 | A1 | 1/2020 | Robertson et al. | |
| 2021/0206526 | A1 | 7/2021 | Kling et al. | |
| 2021/0298541 | A1 | 9/2021 | Robertson et al. | |
| 2022/0024709 | A1 | 1/2022 | Osborne, Jr. | |
| 2022/0225849 | A1 | 7/2022 | Kullman et al. | |
| 2022/0233031 | A1 | 7/2022 | Kullman et al. | |
| 2022/0346606 | A1* | 11/2022 | Lewis | A47K 10/3643 |

FOREIGN PATENT DOCUMENTS

| | | | |
|---|---|---|---|
| CA | 2644361 | C | 4/2015 |
| CA | 2864442 | C | 7/2016 |
| CA | 2864927 | C | 8/2016 |
| CA | 3075508 | A1 | 3/2019 |
| CA | 3075511 | A1 | 3/2019 |
| CA | 3122097 | A1 | 6/2020 |
| CA | 3141907 | A1 | 1/2021 |
| CA | 3141917 | A1 | 1/2021 |
| CA | 3176327 | A1 | 10/2021 |
| EP | 1746922 | B1 | 11/2011 |
| EP | 2004029 | B1 | 3/2017 |
| EP | 2816942 | B1 | 5/2017 |
| EP | 2883486 | B1 | 11/2017 |
| EP | 3136931 | B1 | 3/2018 |
| EP | 3329819 | A1 | 6/2018 |
| EP | 3450366 | A1 | 3/2019 |
| EP | 3150095 | B1 | 4/2020 |
| EP | 3395738 | B1 | 7/2020 |
| EP | 3893708 | A1 | 10/2021 |
| EP | 3993680 | A1 | 5/2022 |
| EP | 3993681 | A1 | 5/2022 |
| MX | 02008623 | A | 5/2003 |
| MX | 06011251 | A | 3/2007 |
| MX | 2008011179 | A | 9/2008 |
| WO | 2021004603 | A1 | 1/2021 |
| WO | 2021004604 | A1 | 1/2021 |
| WO | 2021216138 | A1 | 10/2021 |
| WO | 2022231573 | A1 | 11/2022 |

* cited by examiner

SHEET PRODUCT DISPENSER WITH PRESSURE PLATE LOADING CONTROL

FIELD OF THE INVENTION

Example embodiments of the present invention generally relate to dispensers and, more particularly to, sheet product dispensers.

BACKGROUND

Sheet product dispensers (e.g., toilet paper dispensers) are useful in many environments for providing on demand sheet product, such as toilet paper, for users. Due to their compact nature, it is difficult to provide a large, long-standing supply of sheet product. Thus, janitors or other maintenance personnel (e.g., maintainers) are often required to replace empty rolls of sheet product. For a variety of reasons, however, such as due to a maintenance schedule, a maintainer may decide to replace a roll of sheet product before it has been adequately depleted. However, replacing a not fully depleted roll of sheet product is undesirable as being wasteful.

Improvements in the foregoing are desired.

SUMMARY

Some example embodiments of the present invention include a sheet product dispenser that can lock and prevent a maintainer from replacing individual rolls of sheet product until the roll has been adequately depleted. This gives the greatest opportunity to avoid a scenario in which the maintainer is wasting sheet product by removing an only partially depleted roll from the sheet product dispenser and, in some embodiments, removes the guess work from the maintainer as to when to replace a used roll of sheet product.

Some embodiments of the present invention provide sheet product dispensers that lock a spindle in a dispensing state until a roll of sheet product disposed on the spindle has been adequately depleted. Such sheet product dispensers may then, once the roll of sheet product has been adequately depleted, enable the spindle to move to a loading state by way of movement of a spindle mounting arm such that a maintainer can replace the adequately depleted roll with a full roll of sheet product.

For example, some sheet product dispensers disclosed herein include a housing with a spindle mounting arm disposed therein, the spindle mounting arm having a spindle mounted thereon that extends out to receive a roll of sheet product. The spindle mounting arm may be transitionable between a dispensing state and a loading state, and the spindle mounting arm may further include a pressure plate positioned at least partially therewithin. The pressure plate may be configured such that, when the spindle mounting arm is in the dispensing state and the pressure plate is in an unextended state, rotation of the spindle mounting arm to the loading state is prevented. The pressure plate may be configured to transition to an extended state to allow transition of the spindle mounting arm to the loading state. Notably, the pressure plate is held in the extended state by a side surface of an installed roll of sheet product that has an adequate amount of sheet product thereon. However, once a sufficient amount of sheet product is depleted from the roll, the radius of the roll of sheet product decreases past the pressure plate so that a bias acting on the pressure plate causes the pressure plate to transition to the extended state—thereby enabling the spindle mounting arm to transition to the loading state to allow and encourage a maintainer to replace the now sufficiently depleted roll of sheet product. With a full roll of sheet product installed on the spindle, the maintainer can transition the spindle mounting arm back to the dispensing state.

In an example embodiment, a sheet product dispenser in provided. The sheet product dispenser includes a housing defining a front portion and a back portion with a back wall, a spindle mounting arm disposed within the housing, and a spindle mounted to the spindle mounting arm and extending outwardly therefrom for receiving a roll of sheet product thereon. The spindle mounting arm is transitionable between a dispensing state where the spindle is in a first position and a loading state where the spindle is in a second position, and the first position is spaced further from the back wall of the back portion than the second position. The sheet product dispenser also includes a pressure plate positioned at least partially within the spindle mounting arm and extending along a length of the spindle mounting arm that aligns with a side surface of the roll of sheet product installed on the spindle. The pressure plate is transitionable between an extended state and an unextended state, and the pressure plate is biased to the extended state. When the spindle mounting arm is in the dispensing state and the pressure plate is in the unextended state, the pressure plate is configured to prevent rotation of the spindle mounting arm away from the back wall so as to prevent transition of the spindle mounting arm to the loading state. When the spindle mounting arm is in the dispensing state and the pressure plate is in the extended state, the pressure plate is configured to allow transition of the spindle mounting arm away from the back wall to the loading state. Force from a portion of the side surface of the roll of sheet product installed on the spindle causes the pressure plate to stay in the unextended state, and the bias on the pressure plate causes the pressure plate to transition to the extended state when the force is no longer present. A sufficient amount of sheet product from the roll of sheet product installed on the spindle having been depleted causes the portion of the side surface to no longer be present over the pressure plate.

In some embodiments, the pressure plate may be positioned on the spindle mounting arm at a radial position from the spindle that corresponds to a desired amount of sheet product remaining on the roll of sheet product installed on the spindle such that presence of the side surface of the roll of sheet product over the pressure plate at the radial position prevents premature removal of the roll of sheet product from the spindle.

In some embodiments, a bottom edge of the pressure plate may be curved with a radius of curvature that is consistent with the roll of sheet product when the sufficient amount of sheet product from the roll of sheet product has been depleted.

In some embodiments, a radius of the roll of sheet product when the sufficient amount of sheet product from the roll of sheet product has been depleted may be less than 2.5 centimeters.

In some embodiments, the front portion may include a cover that is movable between a closed state and an open state, and, when the spindle mounting arm is in the dispensing state and the pressure plate is in the extended state, and the cover transitions to the open state, the spindle mounting arm may automatically transition to the loading state so as to encourage a maintainer to install a replacement roll of sheet product on the spindle.

In some embodiments, the sheet product dispenser may further include one or more magnets that are configured to provide a magnetic force that causes the spindle mounting arm to automatically transition to the loading state when the spindle mounting arm is in the dispensing state, the pressure plate is in the extended state, and the cover transitions to the open state.

In some embodiments, the sheet product dispenser may further include at least one biasing member that is configured to interact with the spindle mounting arm to cause the spindle mounting arm to automatically reposition, when the cover is in the open state and the pressure plate is in the extended state, such that gravity acts on the spindle mounting arm to transition the spindle mounting arm to the loading state.

In some embodiments, the spindle mounting arm may be a first spindle mounting arm, where the spindle is a first spindle. The pressure plate may be a first pressure plate, and the housing may define a plurality of distinct sheet product roll dispensing volumes. The first spindle mounting arm, the first spindle, and the first pressure plate may be positioned within a first dispensing volume of the plurality of distinct sheet product roll dispensing volumes, and the dispenser may include at least a second spindle mounting arm, a second spindle, and a second pressure plate that are positioned within a second dispensing volume of the plurality of distinct sheet product roll dispensing volumes. The first spindle mounting arm may be independently transitionable relative to the second spindle mounting arm.

In some embodiments, the first spindle and the second spindle may be positioned so as to define a first axis. The first spindle mounting arm may be transitionable about a first pivot point, and the second spindle mounting arm may be transitionable about a second pivot point. The first pivot point and the second pivot point may define a second axis, and the first axis and the second axis may be aligned.

In some embodiments, the first spindle and the second spindle may be positioned so as to define a first axis. The first spindle mounting arm may be transitionable about a first pivot point, and the second spindle mounting arm may be transitionable about a second pivot point. The first pivot point and the second pivot point may define a second axis, and the first axis and the second axis may be closer to the back wall than the first pivot point and the second pivot point so as to encourage transition of the first spindle mounting arm and the second spindle mounting arm to the loading state.

In some embodiments, the sheet product dispenser may further include a locking mechanism configured to selectively interact with an element on the spindle mounting arm.

In some embodiments, the locking mechanism may be a latch mechanism including a biasing member.

In some embodiments, the element may be a boss, and the boss may be positioned so as to interact with the pressure plate. The boss may be engageable with the locking mechanism when the pressure plate is in the unextended state.

In some embodiments, the boss may include a first slanted surface that is configured to slide along a second slanted surface of the locking mechanism so as to guide the boss into a locked position with respect to the locking mechanism.

In some embodiments, the boss may be configured to be able to overcome the second slanted surface of the locking mechanism such that the spindle transitions into the dispensing state.

In some embodiments, the locking mechanism may be connected to a biasing member, and the biasing member may keep the spindle mounting arm in the dispensing state when the pressure plate is in the unextended state.

In another example embodiment, a dispensing chassis is provided. The dispensing chassis includes a spindle mounting arm rotatably connected to the dispensing chassis and a spindle mounted to the spindle mounting arm and extending outwardly therefrom for receiving a roll of sheet product thereon. The spindle mounting arm is transitionable between a dispensing state where the spindle is in a first position and a loading state where the spindle is in a second position, and the first position is spaced further from the back wall of the back portion than the second position. The dispensing chassis also includes a pressure plate positioned at least partially within the spindle mounting arm and extending along a length of the spindle mounting arm that aligns with a side surface of the roll of sheet product installed on the spindle. The pressure plate is transitionable between an extended state and an unextended state, and the pressure plate is biased to the extended state. When the spindle mounting arm is in the dispensing state and the pressure plate is in the unextended state, the pressure plate is configured to prevent rotation of the spindle mounting arm away from the back wall so as to prevent transition of the spindle mounting arm to the loading state. When the spindle mounting arm is in the dispensing state and the pressure plate is in the extended state, the pressure plate is configured to allow transition of the spindle mounting arm away from the back wall to the loading state. Force from a portion of the side surface of the roll of sheet product installed on the spindle causes the pressure plate to stay in the unextended state, and the bias on the pressure plate causes the pressure plate to transition to the extended state when the force is no longer present. A sufficient amount of sheet product from the roll of sheet product installed on the spindle having been depleted causes the portion of the side surface to no longer be present over the pressure plate.

In some embodiments, the pressure plate may be positioned on the spindle mounting arm at a radial position from the spindle that corresponds to a desired amount of sheet product remaining on the roll of sheet product installed on the spindle such that presence of the side surface of the roll of sheet product over the pressure plate at the radial position prevents premature removal of the roll of sheet product from the spindle.

In some embodiments, the front portion may include a cover that is movable between a closed state and an open state. When the spindle mounting arm is in the dispensing state and the pressure plate is in the extended state, and the cover transitions to the open state, the spindle mounting arm may automatically transition to the loading state so as to encourage a maintainer to install a replacement roll of sheet product on the spindle.

In another example embodiment, a sheet product dispenser is provided. The sheet product dispenser includes a housing defining a front portion and a back portion with a back wall. The housing defines a first sheet product roll dispensing volume and a second sheet product roll dispensing volume, the first sheet product roll dispensing volume being distinct from the second sheet product roll dispensing volume. The first sheet product roll dispensing volume includes a first spindle mounting arm disposed within the first sheet product roll dispensing volume of the housing and a first spindle mounted to the first spindle mounting arm and extending outwardly therefrom for receiving a first roll of sheet product thereon. The first spindle mounting arm is transitionable between a first dispensing state where the first spindle is in a first position and a first loading state where the first spindle is in a second position, and the first position is spaced further from the back wall of the back portion than the second position. The first sheet product roll dispensing volume also includes a first pressure plate positioned at least partially within the first spindle mounting arm and extending along a first length of the first spindle mounting arm that aligns with a side surface of the first roll of sheet product installed on the first spindle. The first pressure plate is transitionable between a first extended state and a first unextended state, and the first pressure plate is biased to the first extended state. When the first spindle mounting arm is in the first dispensing state and the first pressure plate is in the first unextended state, the first pressure plate is configured to prevent rotation of the first spindle mounting arm away from the back wall so as to prevent transition of the first spindle mounting arm to the first loading state. When the first spindle mounting arm is in the first dispensing state and the first pressure plate is in the first extended state, the first pressure plate is configured to allow transition of the first spindle mounting arm away from the back wall to the first loading state. A portion of the side surface of the first roll of sheet product installed on the first spindle causes the first pressure plate to stay in the first unextended state when a first diameter of the first roll of sheet product satisfies a first predetermined threshold, and the bias on the first pressure plate causes the first pressure plate to transition to the first extended state when the first diameter of the first roll of sheet product no longer satisfies the first predetermined threshold. The second sheet product roll dispensing volume includes a second spindle mounting arm disposed within the second sheet product roll dispensing volume of the housing and a second spindle mounted to the second spindle mounting arm and extending outwardly therefrom for receiving a second roll of sheet product thereon. The second spindle mounting arm is transitionable between a second dispensing state where the second spindle is in a first position and a second loading state where the second spindle is in a second position, and the first position is spaced further from the back wall of the back portion than the second position. The second sheet product roll dispensing volume also includes a second pressure plate positioned at least partially within the second spindle mounting arm and extending along a second length of the second spindle mounting arm that aligns with a side surface of the second roll of sheet product installed on the second spindle. The second pressure plate is transitionable between a second extended state and a second unextended state, and the second pressure plate is biased to the second extended state. When the second spindle mounting arm is in the second dispensing state and the second pressure plate is in the second unextended state, the second pressure plate is configured to prevent rotation of the second spindle mounting arm away from the back wall so as to prevent transition of the second spindle mounting arm to the second loading state. When the second spindle mounting arm is in the second dispensing state and the second pressure plate is in the second extended state, the second pressure plate is configured to allow transition of the second spindle mounting arm away from the back wall to the second loading state. A portion of the side surface of the second roll of sheet product installed on the second spindle causes the second pressure plate to stay in the second unextended state when a second diameter of the second roll of sheet product satisfies a second predetermined threshold, and the bias on the second pressure plate causes the second pressure plate to transition to the second extended state when the second diameter of the second roll of sheet product no longer satisfies the second predetermined threshold. The first spindle mounting arm is independently transitionable relative to the second spindle mounting arm.

BRIEF DESCRIPTION OF THE DRAWING(S)

Having thus described the invention in general terms, reference will now be made to the accompanying drawings, which are not necessarily drawn to scale, and wherein:

FIG. 1 shows a perspective view of an example sheet product dispenser, in accordance with some embodiments discussed herein;

FIG. 2 shows a perspective view of the sheet product dispenser of FIG. 1, where a cover is in an open state, with two example spindle mounting arms on the left side of the figure shown in a loading state and two example spindle mounting arms on the right side of the figure shown in a dispensing state with full rolls of sheet product installed thereon, in accordance with some embodiments discussed herein;

Figure 1:
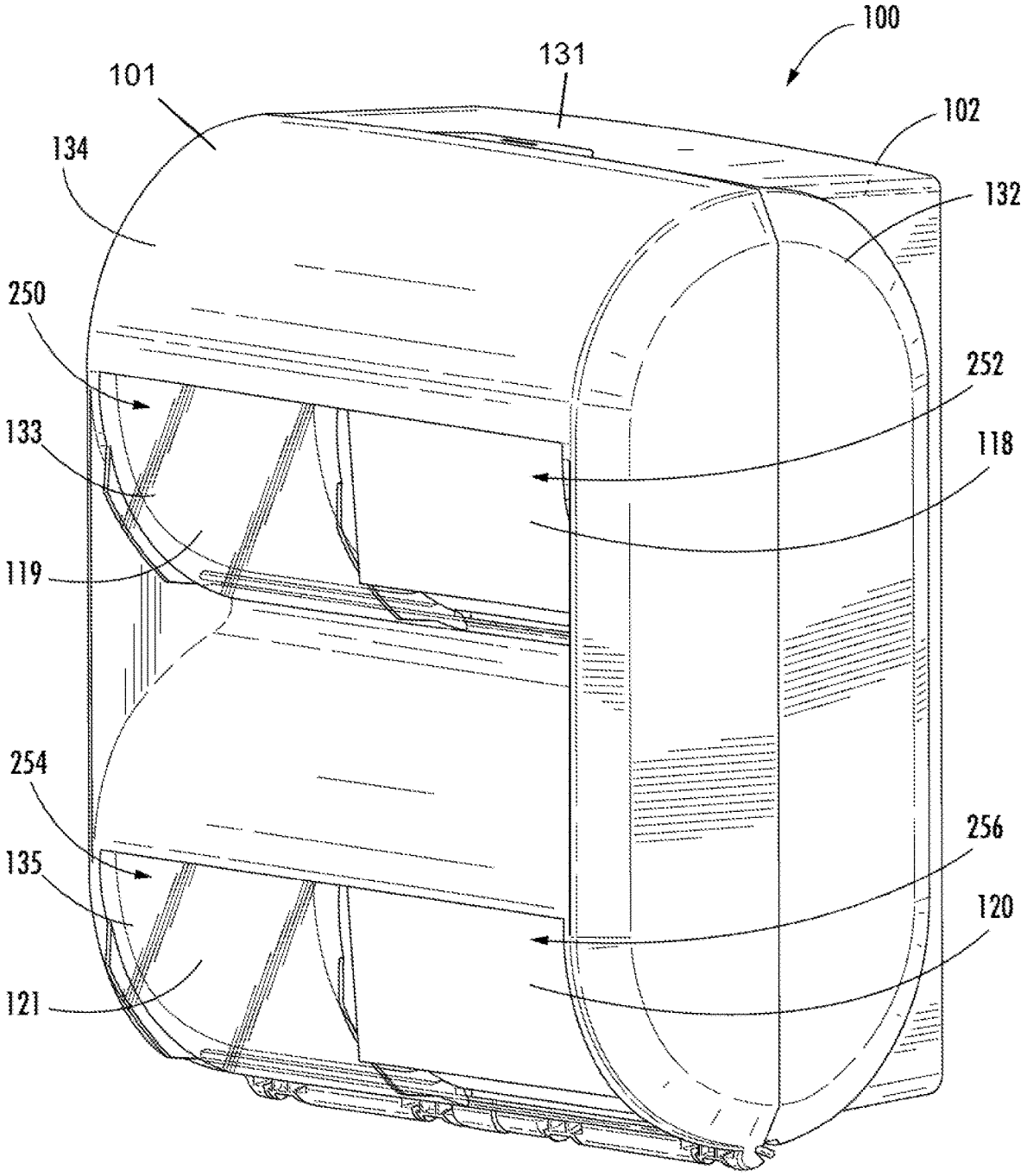
Figure 2:
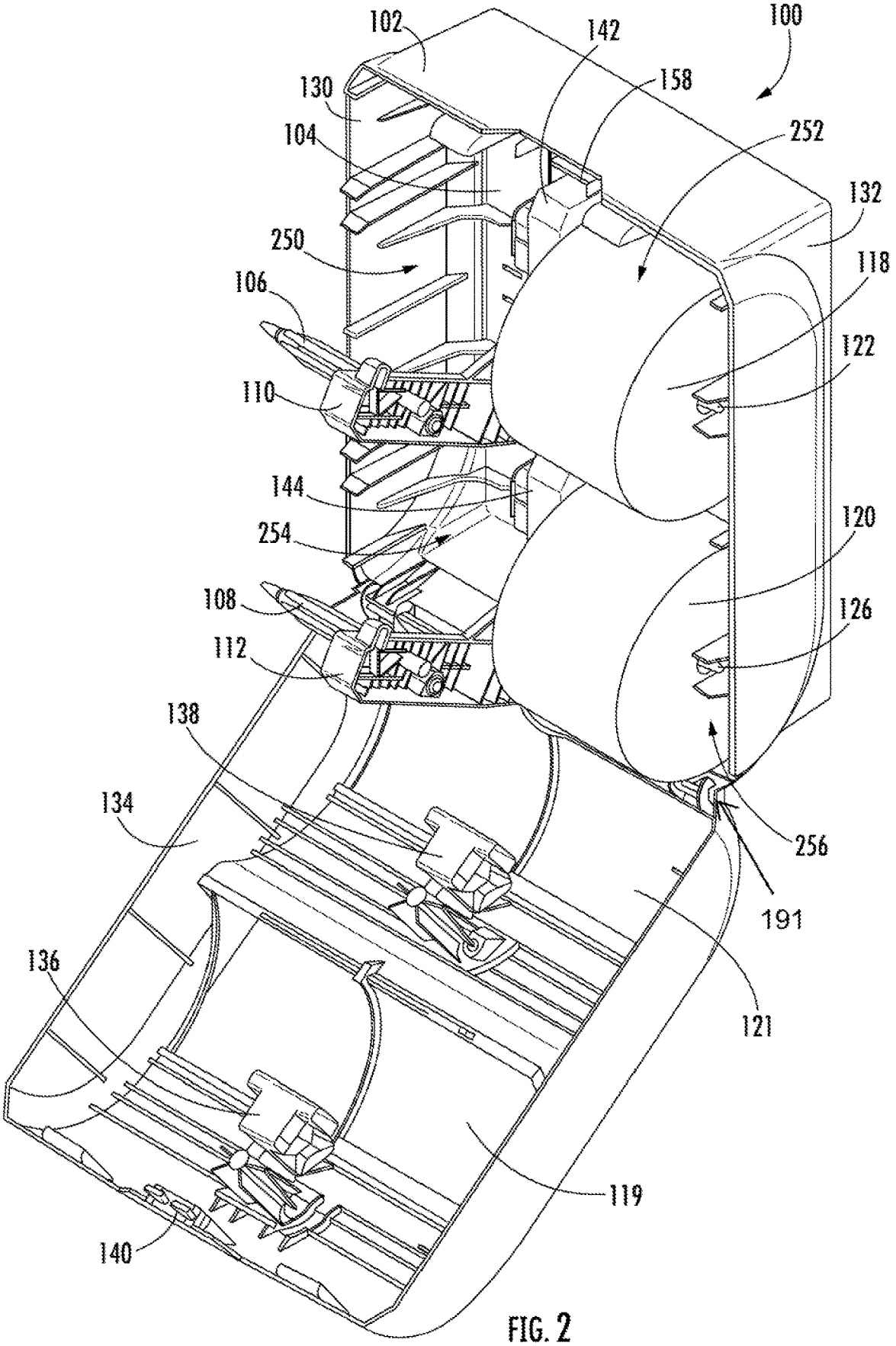
Figure 5:
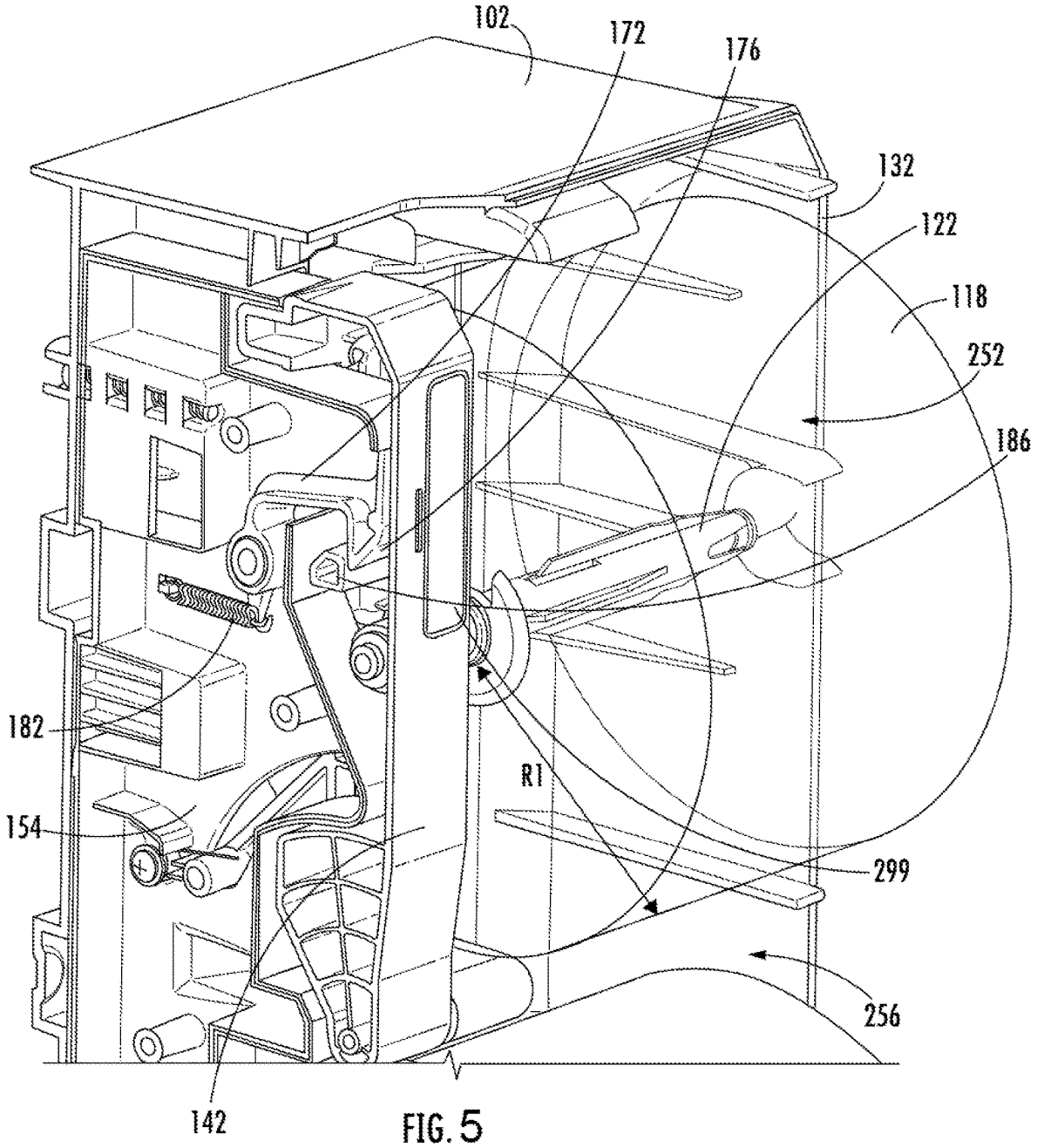
Figure 6B:
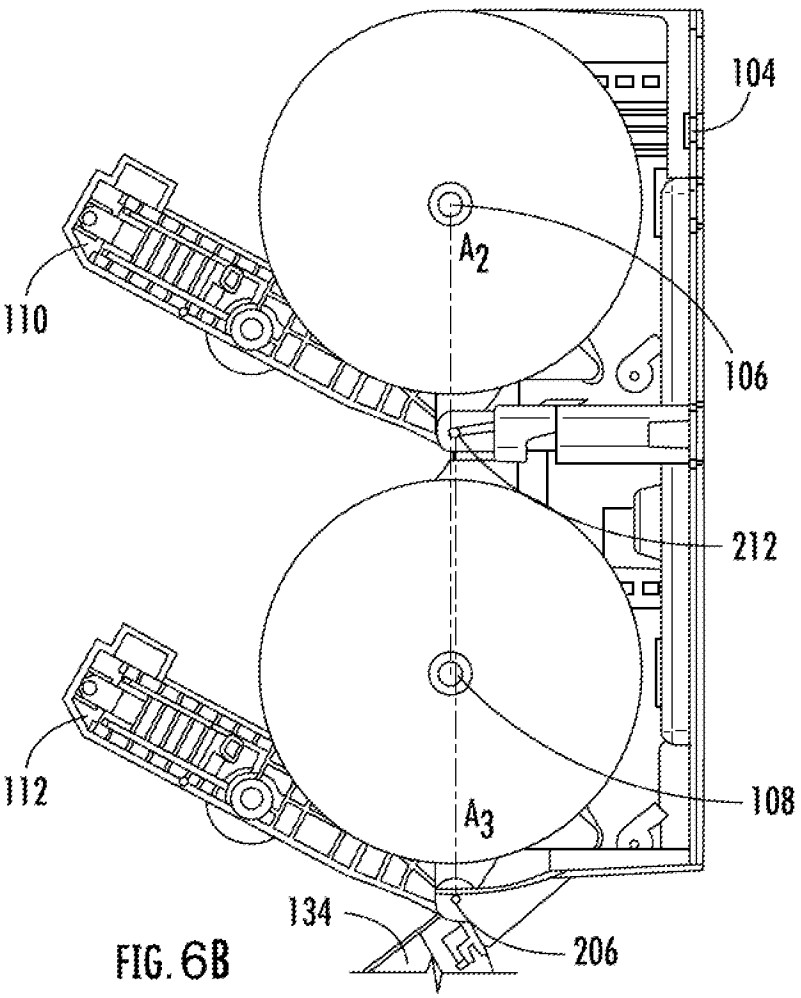
Figure 6A:
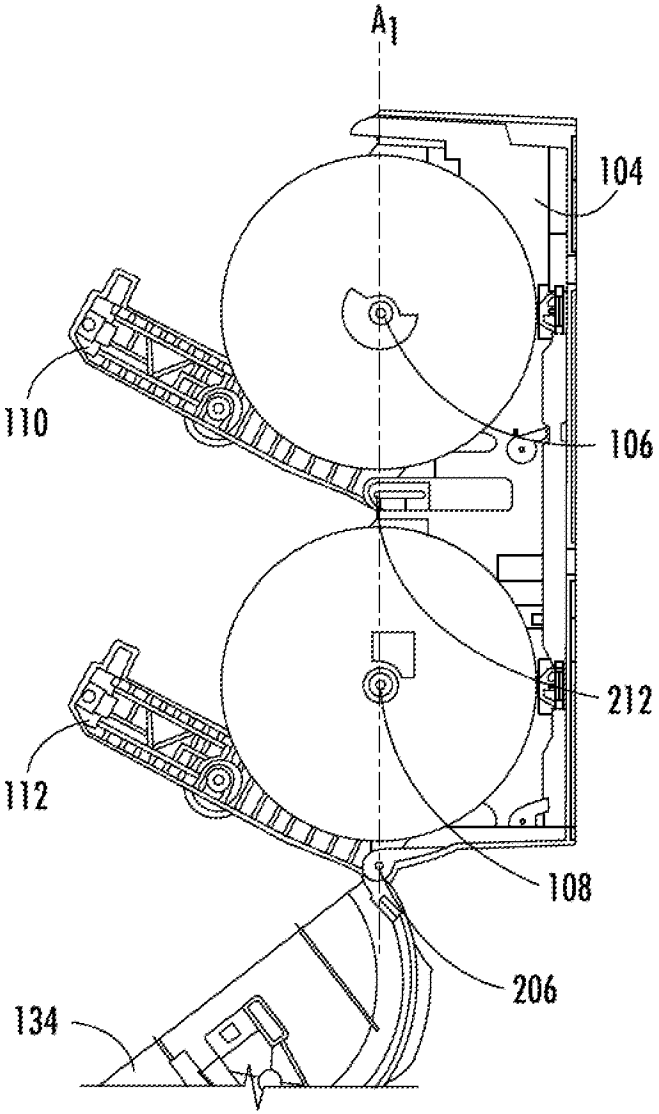

FIG. 5 shows a perspective cross-sectional view of the sheet product dispenser of FIGS. 1-2, wherein a full roll of sheet product has been installed on a spindle and a corresponding spindle mounting arm has been rotated back to the dispensing state, in accordance with some embodiments discussed herein; and FIGS. 6A-6B illustrate example axial alignment of two of the spindles of FIGS. 1-2 with respect to pivot points about which spindle mounting arms of the spindles rotate, in accordance with some embodiments discussed herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As used herein, a "user" of example sheet product dispensers may be a maintainer (e.g., a maintenance person, a janitor, a facility manager, etc.) or a consumer (e.g., a person receiving a dispensed portion of the sheet product).

Some embodiments of the present invention described herein are designed to maximize efficiency of maintenance, usage, and operation for sheet product dispensers. In this regard, some such embodiments are designed to provide for efficient and intuitive loading of sheet product (e.g., toilet paper) to aid a maintainer during loading. Additionally, some embodiments of the present invention seek to avoid a full roll of sheet product or a partially depleted roll of sheet product from being replenished in order to maximize usage of the sheet product, such as by avoiding the scenario where the maintainer throws away unused sheet product.

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue (or toilet paper), facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be torn off by a user.

FIGS. 1-2 illustrate an example sheet product dispenser 100 according to some embodiments of the present invention. The sheet product dispenser 100 includes a housing defined by a front portion 101 and a back portion 102 with a back wall 104, a first side wall 130, a second side wall 132, and a top wall 131. The sheet product dispenser 100 may also include a bottom wall (not shown) opposite the top wall 131. Further, the sheet product dispenser 100 may include a cover 134. The sheet product dispenser 100 may define four sheet product dispensing volumes from which the sheet product (e.g., toilet paper) is provided to the user. With reference to FIG. 2, the sheet product dispenser 100 includes a first sheet product dispensing volume 250, a second sheet product dispensing volume 252, a third sheet product dispensing volume 254, and a fourth sheet product dispensing volume 256. Returning to FIG. 1, the first sheet product dispensing volume 250 includes a first roll of sheet product 119 and the second sheet product dispensing volume 252 includes a second roll of sheet product 118. The cover 134 of the sheet product dispenser 100 further includes a first door cover 133 that is slidable between covering the first sheet product dispensing volume 250 and the second sheet product dispensing volume 252 by a user. Similarly, the third sheet product dispensing volume 254 includes a third roll of sheet product 121 and the fourth sheet product dispensing volume 256 includes a fourth roll of sheet product 120. The cover 134 of the sheet product dispenser 100 further includes a second door cover 135 that is slidable between covering the third sheet product dispensing volume 254 and the fourth sheet product dispensing volume 256 by a user.

The sheet product dispenser 100 may be configured, in some embodiments, to allow a user to receive a portion of sheet product from one of the dispensing volumes 250, 252, 254, or 256 by pulling the sheet product through an opening in the cover 134 and then ripping or tearing the portion of sheet product from the roll of sheet product within the sheet product dispenser 100. The first door cover 133 may prevent the user from accessing the first roll of sheet product 119 until a sufficient amount of sheet product has been depleted from the currently available second roll of sheet product 118. Once a sufficient amount of sheet product has been depleted from the currently available second roll of sheet product 118, the first door cover 133 may be slid by a user to cover the second dispensing volume 252, leaving the first dispensing volume 250 and the corresponding first roll of sheet product 119 therein accessible for dispensing. Similarly, the second door cover 135 may prevent the user from accessing the third roll of sheet product 121 until a sufficient amount of sheet product has been depleted from the currently available fourth roll of sheet product 120. Once a sufficient amount of sheet product has been depleted from the currently available fourth roll of sheet product 120, the second door cover 135 may be slid by a user to cover the fourth dispensing volume 256, leaving the third dispensing volume 254 and the corresponding third roll of sheet product 121 therein accessible for dispensing.

As shown by FIG. 2, the cover 134 may be configured to open (e.g., rotate forward about a hinge 191) so that a maintainer can replenish one or more of the rolls therein. That is, the front portion of the housing may form the cover 134 that is movable between a closed state and an open state. The cover may be securable in the closed state by a locking mechanism, which may, for example, include a first member 140 on the front portion 101 that is received and locked within a second member 158 on the back portion 102. A key may be used, for example, to unlock the cover 134 for opening. In some embodiments, a push button or other opening feature may be utilized and the cover 134 may or may not be locked when in the closed state.

As illustrated, the first dispensing volume 250 contains a first spindle mounting arm 110 with a first spindle 106. The second dispensing volume 252 contains a second spindle mounting arm 142 with a second spindle 122, and a roll of sheet product 118 is disposed on the spindle 122. The third dispensing volume 254 contains a third spindle mounting arm 112 with a third spindle 108. The fourth dispensing volume 256 contains a fourth spindle mounting arm 144 with a fourth spindle 126, and a roll of sheet product 120 is disposed on the spindle 126.

One or more of the spindle mounting arms may provide for controlled loading of sheet product thereon, such as by preventing a maintainer from replacing a roll of sheet product until a sufficient amount of sheet product has been depleted from the roll. For example, as shown in FIG. 2, the spindle mounting arms 142 and 144 of the sheet product dispensing volumes 252 and 256, respectively, have not transitioned out into their loading states when the cover 134 is moved from the closed state to the open state because the rolls of sheet product 118 and 120 disposed on the spindles 122 and 126 thereof are not adequately depleted. However, the spindle mounting arms 110 and 112 of the sheet product dispensing volumes 250 and 254, respectively, have transitioned to their loading states when the cover 134 is moved from the closed state to the open state because there are no rolls of sheet product disposed on the spindles 106 and 108 thereof.

It should be appreciated that the sheet product dispenser 100 may include more or less sheet product dispensing volumes than the four shown in FIGS. 1-2. For example, the sheet product dispenser 100 may include only one sheet product dispensing volume, or the sheet product dispenser 100 may include six sheet product dispensing volumes. In embodiments that include more than one sheet product dispensing volume, the spindle mounting arms may be independently transitionable relative to each other. For example, in the embodiment shown in FIG. 2, the spindle mounting arms 110, 142, 112, and 144 may be independently transitionable relative to each other such that, for example, the spindle mounting arm 110 can transition into the loading state even when the spindle mounting arm 142 does not.

Figure 3:
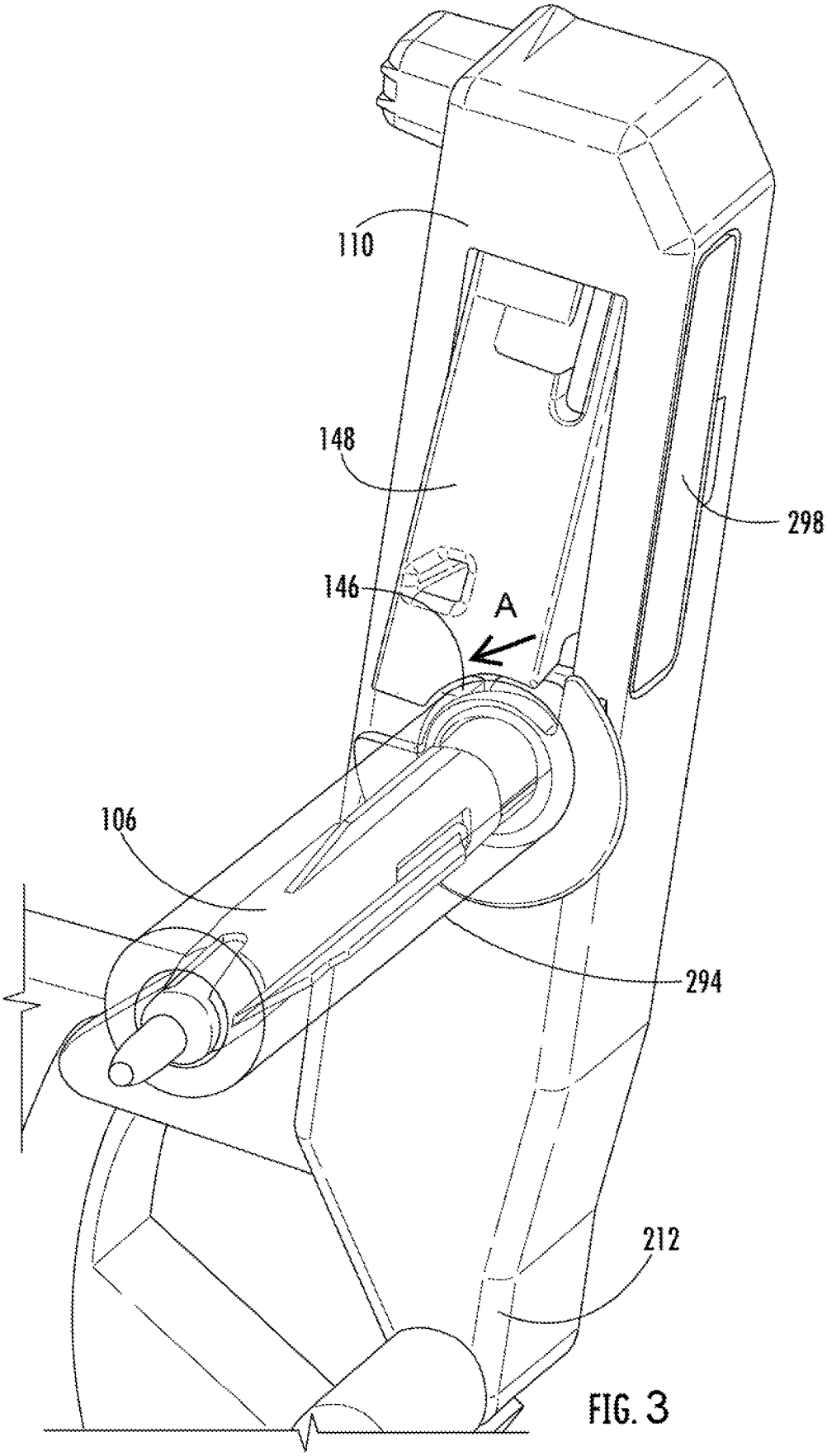
FIG. 3 shows a spindle mounting arm of the sheet product dispenser of FIG. 1-2, where an installed roll of sheet product has been depleted sufficiently such that a pressure plate on the spindle mounting arm has transitioned to an extended state, in accordance with some embodiments discussed herein.

FIG. 3 shows an isolated view of the spindle mounting arm 110 of the first sheet product dispensing volume 250 of the sheet product dispenser 100. The spindle mounting arm 110 has transitioned to the loading state with a nearly depleted roll of sheet product 294 disposed thereon. In this regard, in the embodiment shown, the roll of sheet product 294 has been adequately depleted. For example, the radius of the roll of sheet product 294 is smaller than the radii of the rolls of sheet product 118 and 120 shown in FIG. 2, which have not been adequately depleted. Notably, the spindle mounting arm 110 includes a pressure plate 148 positioned at least partially within the spindle mounting arm 110 and extending along a length of the spindle mounting arm 110 that aligns with a side surface of the roll of sheet product 294 installed on the spindle 106. The pressure plate 148 is transitionable between an extended (or disengaged) state and an unextended (or engaged) state, and the pressure plate 148 may be biased to the extended state. Before the roll of sheet product 294 had been adequately depleted (e.g., when the roll 294 had a greater diameter), force from a portion of the side surface of the roll of sheet product 294 installed on the spindle 106 caused the pressure plate 148 to be in the unextended state. However, once the roll of sheet product 294 had been adequately depleted, as shown in FIG. 3 (e.g., once the radius of the roll of sheet product 294 is small enough so that it no longer engages the pressure plate 148), the bias on the pressure plate 148 caused the pressure plate 148 to transition (e.g., along arrow A) to the extended (or disengaged) state because the force is no longer present. Notably, when the spindle mounting arm 110 is in the dispensing state and the pressure plate 148 is in the unextended state, the pressure plate 148 may be configured to prevent rotation of the spindle mounting arm 110 away from the back wall 104 so as to prevent transition of the spindle mounting arm 110 to the loading state, and when the spindle mounting arm 110 is in the dispensing state and the pressure plate 148 is in the extended state, the pressure plate 148 may be configured to allow transition of the spindle mounting arm 110 away from the back wall 104 to the loading state (such as illustrated by arrow B in FIG. 4).

In this regard, the pressure plate 148 may be positioned on the spindle mounting arm 110 at a radial position from the spindle 106 that corresponds to a desired amount of sheet product remaining on the roll of sheet product 294 installed on the spindle 106 such that presence of the side surface of the roll of sheet product 294 over the pressure plate 148 at the radial position prevents premature removal of the roll of sheet product 294 from the spindle. Thus, a portion of the side surface of the roll of sheet product 294 installed on the spindle 106 may cause the pressure plate 148 to stay in the unextended state when a diameter of the roll of sheet product 294 satisfies a predetermined threshold, and the bias on the pressure plate 148 may cause the pressure plate 148 to transition to the extended state when the diameter of the roll of sheet product 294 no longer satisfies the predetermined threshold. In some embodiments, the pressure plate 148 may have a bottom curved edge 146 with a radius of curvature that is consistent with the roll of sheet product 294 when the sufficient amount of sheet product from the roll of sheet product 294 has been depleted. For example, in some embodiments, a radius of the roll of sheet product 294 when the sufficient amount of sheet product from the roll of sheet product 294 has been depleted may be less than 2.5 centimeters, but any other value is contemplated.

Figure 4:
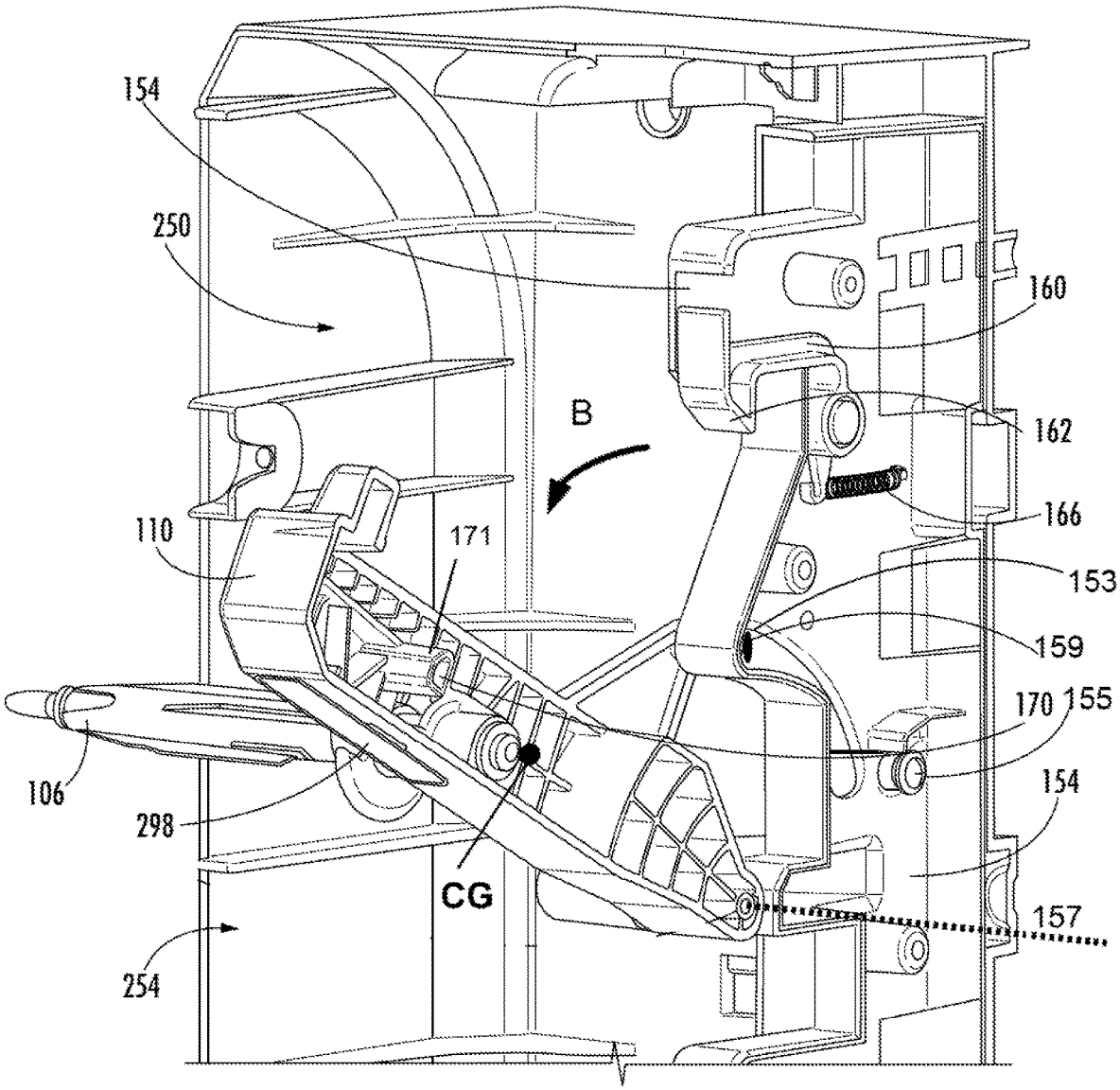
FIG. 4 shows a perspective cross-sectional view of the sheet product dispenser of FIGS. 1-2, wherein the spindle mounting arm of FIG. 3 is shown in the loading state, in accordance with some embodiments discussed herein.

FIG. 4 shows a cross-sectional view of the first sheet product dispensing volume 250 of the sheet product dispenser 100 when the spindle 106 does not have a roll of sheet product disposed thereon and when the spindle mounting arm 110 is in the loading state. The cross-section view of a dispensing chassis 154 of the sheet product dispenser 100 shows a locking mechanism 160 that is selectively interactable with the spindle mounting arm 110 (e.g., with a boss 170 of the spindle mounting arm 110) when the pressure plate 148 is engaged (this is illustrated in FIG. 5 with the spindle mounting arm 142). That is, the locking mechanism 160, which may be a latch mechanism or any other type of mechanism, may be, in some embodiments, connected to a biasing member 166, which may be connected to the dispensing chassis 154. The locking mechanism 160 (e.g., the latch) may be configured to engage with the boss 170 when the pressure plate 148 is engaged. That is, the engagement of a roll of sheet product with the pressure plate 148 may cause the boss to move into a plane of interaction such that it can be, e.g., latched by the locking mechanism 160 when the spindle mounting arm 110 is in the dispensing state. Once a roll of sheet product is no longer engaging the pressure plate 148 (e.g., because the roll of sheet product has been adequately depleted), the boss 170 would then move out of the plane of interaction (e.g., along arrow A in FIG. 3 with the pressure plate 148) and cause the locking mechanism 160 to no longer engage with the boss 170—thereby allowing the spindle mounting arm 110 to be movable out of the dispensing state.

Once a roll of sheet product with an adequate amount of sheet product thereon is loaded back onto the spindle 106, the pressure plate 148 transitions to the unextended state and, thus, the boss 170 is pushed inward toward the dispensing chassis 154. The spindle mounting arm 110 may then be moved into the dispensing state (e.g., opposite to the direction of arrow B in FIG. 4), and in doing so, the boss 170 may be interactable with the locking mechanism 160 because the pressure plate 148 is engaged. For example, in some embodiments, a first slanted surface 171 of the boss 170 may be configured (when the pressure plate 148 is engaged) to slide along a second slanted surface 162 of the locking mechanism 160 so as to guide the boss 170 into a locked position with respect to the locking mechanism 160. That is, the boss 170 may be configured to be able to overcome the second slanted surface 162 of the locking mechanism 160 such that the spindle 106 transitions into the dispensing state. The biasing member 166 may then keep the spindle mounting arm 110 in the dispensing state while the pressure plate 148 is in the unextended state. Thus, the boss 170 may remain in the locked position, and the spindle 106 may therefore remain in the dispensing state, until the pressure plate 148 is no longer engaged (e.g., due to the roll of sheet product no longer having an adequate amount of sheet product thereon).

FIG. 5 shows a cross-sectional view of the second sheet product dispensing volume 252 of the sheet product dispenser 100 when the spindle 122 has the roll of sheet product 118 disposed thereon and when the spindle mounting arm 142 is locked in the dispensing state. The roll of sheet product 118 has a radius $R_1$, which may be, in some embodiments, an adequate amount of sheet product. Because the roll of sheet product 118 had an adequate amount of sheet product thereon when the roll of sheet product was placed on the spindle 122, the pressure plate of the spindle mounting arm 142 was engaged and the boss 186 was moved into a plane of interaction of the locking mechanism 172 (e.g., a latch mechanism). The boss then slid along a slanted surface 176 of the locking mechanism 172 until the boss 186 moved into the locked position with respect to the locking mechanism 172, as is shown in FIG. 5. The biasing member 182, which is connected to the locking mechanism 172 and the dispensing chassis 154, acts on the locking mechanism 172 to keep the boss 186 in the locked position. Accordingly, the spindle mounting arm 142 with the full roll of sheet product 118 thereon cannot transition to the loading state such that a maintainer may not prematurely replace the roll of sheet product 118.

It should be appreciated that the locking mechanisms and bosses described herein may be configured differently. For example, the locking mechanisms described herein are configured as latch mechanisms that interact with bosses only when the bosses are moved into a plane of interaction of the locking mechanisms by their respective pressure plates. It should be appreciated that other locking mechanisms are also contemplated, which might not include, for example, bosses, planes of interaction, or latches.

Each of the spindle mounting arms 110, 142, 112, and 144 within the sheet product dispenser 100 may optionally include a compartment, such as compartments 298 and 299 on spindle mounting arms 110 and 142, respectively, that serve as backup features. That is, the compartments may accept a key, for example, and may be operable to allow a maintainer or a supervisor of the maintainer to access the sheet product dispensing volume no matter the amount of sheet product on a roll disposed on the spindle of that spindle mounting arm. This may be useful, for example, if a roll of sheet product that has an adequate amount of sheet product thereon gets wet while it is on one of the spindles. The backup feature may allow the maintainer or supervisor to move the boss out from the locked position with respect to the locking mechanism and move the spindle mounting arm back into the loading state so that the wet roll of sheet product can be replaced with a dry roll of sheet product.

In some embodiments, the sheet product dispenser 100 may be configured to aid in actively transitioning the spindle mounting arms to their respective loading states when the corresponding spindles contain rolls of sheet product that are adequately depleted (or when the spindles contain no rolls of sheet product at all). For example, referring back to FIG. 4, the dispensing chassis 154 may further include a biasing member (e.g., torsion spring 155) that interacts with a portion 159 of the spindle mounting arm 110 that, e.g., slides within a slot 153 of the dispensing chassis 154. The torsion spring 155 acts to bias the spindle mounting arm 110 away from the dispensing chassis 154 such that, when the pressure plate 148 of the spindle mounting arm 110 is in the extended state, the spindle mounting arm 110 is biased to rotate (e.g., along arrow B) to a position where a center of gravity CG of the spindle mounting arm 110 is past a vertical plane corresponding to a rotation axis 157 of the spindle mounting arm 110. This allows gravity to act on the spindle mounting arm 110 so as to cause the spindle mounting arm 110 to transition (under a bias of gravity) to the loading state.

As another example, referring back to FIG. 2, the cover 134 may include magnets (e.g., at junctures 136 and/or 138) that are configured to aid the spindle mounting arms 110, 142, 112, and 144 in moving to their respective loading states when the spindles 106, 122, 108, and 126 contain rolls of sheet product that are adequately depleted (or when the spindles contain no rolls of sheet product at all). That is, one or more magnets on or within the cover 134 may be configured to provide a magnetic force that causes a spindle mounting arm to automatically transition to the loading state when the spindle mounting arm is in the dispensing state, when the pressure plate of the spindle mounting arm is in the extended state, and when the cover 134 transitions to the open state. For example, each of the spindle mounting arms 110, 142, 112, and 144 may have magnets that are interactable with magnets disposed within the cover 134 (e.g., at junctures 136 and/or 138), and the magnets in the cover 134 may cause the spindle mounting arms 110 and 112 to move from their dispensing states to their loading states because there are no rolls of sheet product disposed on the spindles 106 and 108 (or, in other embodiments, because there are rolls of sheet product disposed on the spindles 106 and 108 that are adequately depleted). However, as described herein, because the spindles 122 and 126 have rolls of sheet product 118 and 120 disposed thereon that have not yet been adequately depleted, the magnets in the cover 134 would not cause the spindle mounting arms 142 and 144 to move from their dispensing states.

As another example, referring to FIG. 6A, a pivot point 212 of the spindle mounting arm 110 may be in line with the spindle 106 connected to the spindle mounting arm 110 when the spindle 106 is in the dispensing state. Similarly, a pivot point 206 of the spindle mounting arm 112 may be in line with the spindle 108 connected to the spindle mounting arm 112 when the spindle 108 is in the dispensing state. In other words, the spindle 106, the spindle 108, the pivot point 212, and the pivot point 206 may all be aligned along an axis $A_1$. As described above, magnets may be included in the cover 134 and the spindles 106 and 108 and/or spindle mounting arms 110 and 112 such that the spindle mounting arms 110 and 112, which are unlocked, transition to their loading states when the cover is opened because of the active pull from the magnets in the cover 134. Alternatively, the cover 134 may not include magnets, and the system may require a user to actively transition the unlocked spindle mounting arms 110 and 112 into their loading states once the cover 134 has been opened.

In some embodiments, the sheet product dispenser 100 may be configured to passively aid in transitioning the spindle mounting arms to their respective loading states when the corresponding spindles contain rolls of sheet product that are adequately depleted (or when the spindles contain no rolls of sheet product at all). For example, pivot points of the spindle mounting arms may be strategically aligned with respect to dispensing states of their respective spindles such that the spindle mounting arms passively fall into their loading states due to gravitational forces when the spindles contain rolls of sheet product that are adequately depleted (or when the spindles contain no rolls of sheet product at all).

For example, as shown by FIG. 6B, the pivot point 212 of the spindle mounting arm 110 may be offset from the spindle 106 connected to the spindle mounting arm 110 when the spindle 106 is in the dispensing state such that the spindle mounting arm 110 automatically falls from the dispensing state to the loading state due to gravitational forces when the cover 134 is moved from the closed state to the open state and when a roll of sheet product disposed on the spindle 106 has been adequately depleted. The offset may be such that the pivot point 212 is closer to the back wall 104 than is the spindle 106 when the spindle mounting arm 110, and therefore the spindle 106, are in the dispensing state and dispensing state, respectively. Similarly, the pivot point 206 of the spindle mounting arm 112 may be offset from the spindle 108 connected to the spindle mounting arm 112 when the spindle 108 is in the dispensing state such that the spindle mounting arm 112 automatically falls from the dispensing state to the loading state due to gravitational forces when the cover 134 is moved from the closed state to the open state and when a roll of sheet product disposed on the spindle 108 has been adequately depleted. The offset may be such that the pivot point 206 is closer to the back wall 104 than is the spindle 108 when the spindle mounting arm 112, and therefore the spindle 108, are in the dispensing state and dispensing state, respectively. In other words, the spindles 106 and 108 may be positioned such that they define a first axis $A_2$, and the pivot points 212 and 206 may be positioned such that they define a second axis $A_3$. The first axis $A_2$ and the second axis $A_3$ may then be offset by a non-zero amount such that the second axis $A_3$ is closer to the back portion 104 than is the first axis $A_2$. In some embodiments, magnets or maneuvering by the maintainer may be unnecessary for the passive transition due to the forces from gravity being enough. However, in other embodiments, the configuration shown in FIG. 6B may be accompanied by magnets in the cover 134 and/or maneuvering by a user to help cause the spindle mounting arms 110 and/or 112 to move to their loading states when rolls of sheet product disposed thereon have been adequately depleted and when the cover 134 is opened.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A sheet product dispenser comprising:

a spindle mounting arm;

a spindle mounted to the spindle mounting arm for receiving a roll of sheet product thereon, wherein the spindle mounting arm is transitionable between a dispensing state and a loading state; and a pressure plate positioned along the spindle mounting arm to align with a side surface of the roll of sheet product when the roll of sheet product is installed on the spindle, wherein the pressure plate is biased to an extended state and is transitionable to an unextended state in response to a force from the side surface of the roll of the sheet product, wherein, when the spindle mounting arm is in the dispensing state, the pressure plate in the unextended state prevents transition of the spindle mounting arm to the loading state and the pressure plate in the extended state allows transition of the spindle mounting arm to the loading state.

2. The sheet product dispenser of claim 1, wherein a bottom edge of the pressure plate is positioned on the spindle mounting arm at a radial position from the spindle such that when a predetermined amount of sheet product is depleted from the roll of sheet product, the side surface of the roll of sheet product does not contact the pressure plate.

3. The sheet product dispenser of claim 1, further comprising a cover that is movable between a closed state and an open state, wherein, when the spindle mounting arm is in the dispensing state and the pressure plate is in the extended state, and the cover transitions to the open state, the spindle mounting arm automatically transitions to the loading state so as to encourage a maintainer to install a replacement roll of sheet product on the spindle.

4. The sheet product dispenser of claim 3 further comprising one or more magnets that provide a magnetic force that causes the spindle mounting arm to automatically transition to the loading state when the spindle mounting arm is in the dispensing state, the pressure plate is in the extended state, and the cover transitions to the open state.

5. The sheet product dispenser of claim 3 further comprising at least one biasing member that interacts with the spindle mounting arm to cause the spindle mounting arm to automatically reposition, when the cover is in the open state and the pressure plate is in the extended state, such that gravity acts on the spindle mounting arm to transition the spindle mounting arm to the loading state.

6. The sheet product dispenser of claim 1, wherein the spindle mounting arm is a first spindle mounting arm, where the spindle is a first spindle, and wherein the pressure plate is a first pressure plate, wherein the sheet product dispenser comprises a housing that defines a plurality of distinct sheet product roll dispensing volumes, wherein the first spindle mounting arm, the first spindle, and the first pressure plate are positioned within a first dispensing volume of the plurality of distinct sheet product roll dispensing volumes when in the dispensing state, and wherein the sheet product dispenser comprises at least a second spindle mounting arm, a second spindle, and a second pressure plate that are positioned within a second dispensing volume of the plurality of distinct sheet product roll dispensing volumes when in a dispensing state, wherein the first spindle mounting arm is independently transitionable relative to the second spindle mounting arm.

7. The sheet product dispenser of claim 6, wherein the first spindle and the second spindle are positioned so as to define a first axis, wherein the first spindle mounting arm is transitionable about a first pivot point, wherein the second spindle mounting arm is transitionable about a second pivot point, wherein the first pivot point and the second pivot point define a second axis, and wherein the first axis and the second axis are aligned.

8. The sheet product dispenser of claim 6, wherein the first spindle and the second spindle are positioned so as to define a first axis, wherein the first spindle mounting arm is transitionable about a first pivot point, wherein the second spindle mounting arm is transitionable about a second pivot point, wherein the first pivot point and the second pivot point define a second axis, and wherein the first axis and the second axis are closer to a back wall of a housing of the sheet product dispenser than the first pivot point and the second pivot point so as to encourage transition of the first spindle mounting arm and the second spindle mounting arm to the loading state.

9. The sheet product dispenser of claim 1, wherein the sheet product dispenser further comprises a locking mechanism configured to selectively interact with an element of the pressure plate of the spindle mounting arm.

10. The sheet product dispenser of claim 9, wherein the locking mechanism is a latch mechanism comprising a biasing member.

11. The sheet product dispenser of claim 9, wherein the element is engageable with the locking mechanism when the pressure plate is in the unextended state.

12. The sheet product dispenser of claim 11, wherein the element comprises a first slanted surface that is configured to slide along a second slanted surface of the locking mechanism so as to guide the element into a locked position with respect to the locking mechanism.

13. A dispensing chassis comprising:

a spindle mounting arm rotatably connected to the dispensing chassis;

a spindle mounted to the spindle mounting arm for receiving a roll of sheet product thereon;

a biased member positioned on the spindle mounting arm and movable from a biased disengaged state and an engaged state in response to the roll of sheet product being installed onto the spindle; and the spindle mounting arm movable between a dispensing state wherein the spindle is in a dispensing position and a loading state wherein the spindle is in a loading position, wherein the biased member is at least partially positioned within the spindle mounting arm when transitioning to the engaged state, and the biased member, when in the engaged state, prevents the spindle mounting arm with the spindle from moving from the dispensing state to the loading state.

14. The dispensing chassis of claim 13, wherein a bottom edge of the biased member is positioned on the spindle mounting arm at a radial position from the spindle such that when a predetermined amount of sheet product is depleted from the roll of sheet product, the roll of sheet product does not contact the biased member.

15. The dispensing chassis of claim 13, further comprising a cover that is movable between a closed state and an open state, wherein, when the spindle mounting arm is in the dispensing state and the biased member is in the disengaged state, and the cover transitions to the open state, the spindle mounting arm automatically transitions to the loading state so as to enable installation of a replacement roll of sheet product on the spindle.

16. The dispensing chassis of claim 15 further comprising one or more magnets that provide a magnetic force that causes the spindle mounting arm to automatically transition to the loading state when the spindle mounting arm is in the dispensing state, the biased member is in the disengaged state, and the cover transitions to the open state.

17. The dispensing chassis of claim 15 further comprising at least one biasing member that interacts with the spindle mounting arm to cause the spindle mounting arm to automatically reposition, when the cover is in the open state and the biased member is in the disengaged state, such that gravity acts on the spindle mounting arm to transition the spindle mounting arm to the loading state.

18. The dispensing chassis of claim 13, wherein the spindle mounting arm is a first spindle mounting arm, where the spindle is a first spindle, and wherein the biased member is a first biased member, wherein the dispensing chassis defines a housing that defines a plurality of distinct sheet product roll dispensing volumes, wherein the first spindle mounting arm, the first spindle, and the first biased member are positioned within a first dispensing volume of the plurality of distinct sheet product roll dispensing volumes when in the dispensing state, and wherein the sheet product dispenser comprises at least a second spindle mounting arm, a second spindle, and a second biased member that are positioned within a second dispensing volume of the plurality of distinct sheet product roll dispensing volumes when in a dispensing state, wherein the first spindle mounting arm is independently transitionable relative to the second spindle mounting arm.

19. A sheet product dispenser comprising:

a housing defining a first sheet product dispensing volume;

a first spindle for receiving a first roll of sheet product;

a first spindle mounting arm operable to move the first spindle from a first dispensing position within the first sheet product dispensing volume to a first loading position outside of the first sheet product dispensing volume; and a first biased member that is biased to a first extended position and is movable to a first unextended position in response to the first sheet product roll being installed onto the first spindle;

the first spindle mounting arm retaining the first spindle in the first dispensing position when the first biased member is forced to the first unextended position by the first sheet product roll, and the first spindle mounting arm operable to move the first spindle to the first loading position in response to the first biased member relaxing to the first extended position upon a predetermined depletion of the first sheet product roll.

20. The sheet product dispenser of claim 19, wherein the housing further defines a second sheet product dispensing volume, wherein the sheet product dispenser further comprises:

a second spindle for receiving a second roll of sheet product;

a second spindle mounting arm operable to move the second spindle from a second dispensing position within the second sheet product dispensing volume to a second loading position outside of the second sheet product dispensing volume; and a second biased member that is biased to a second extended position and is movable to a second unextended position in response to the second sheet product roll being installed onto the second spindle;

the second spindle mounting arm retaining the second spindle in the second dispensing position when the second biased member is forced to the second unextended position by the second sheet product roll, and the second spindle mounting arm operable to move the second spindle to the second loading position in response to the second biased member relaxing to the second extended position upon a predetermined depletion of the second sheet product roll.

* * * * *